US008323077B2

(12) United States Patent
Nakoff

(10) Patent No.: US 8,323,077 B2
(45) Date of Patent: Dec. 4, 2012

(54) BLADE SHARPENING ASSEMBLY

(75) Inventor: Keith Michael Nakoff, Elizabethton, TN (US)

(73) Assignee: Taylor Brands, LLC, Kingsport, TN (US)

( * ) Notice: Subject to any disclaimer, the term of this patent is extended or adjusted under 35 U.S.C. 154(b) by 349 days.

(21) Appl. No.: 12/690,203

(22) Filed: Jan. 20, 2010

(65) Prior Publication Data

US 2011/0177769 A1 Jul. 21, 2011

(51) Int. Cl.
*B24B 3/54* (2006.01)

(52) U.S. Cl. ..... 451/367; 451/371; 451/321

(58) Field of Classification Search ..... 451/321, 451/371, 380, 555, 558
See application file for complete search history.

(56) References Cited

U.S. PATENT DOCUMENTS 4,216,627 A * 8/1980 Westrom ..... 451/175
4,441,279 A * 4/1984 Storm et al. ..... 451/175
4,471,951 A * 9/1984 LeVine ..... 269/3
4,512,112 A * 4/1985 LeVine ..... 451/371
4,714,239 A * 12/1987 LeVine ..... 269/3
5,138,801 A * 8/1992 Anthon et al. ..... 451/540
5,363,602 A * 11/1994 Anthon et al. ..... 451/540
5,431,068 A * 7/1995 Alsch ..... 76/82
6,579,163 B1 * 6/2003 Ross et al. ..... 451/545
7,144,310 B2 * 12/2006 Longbrake ..... 451/349

* cited by examiner

*Primary Examiner* — Dung Van Nguyen
(74) *Attorney, Agent, or Firm* — Luedeka Neely Group, PC

(57) ABSTRACT

A blade sharpening assembly generally including a pair of clamping members disposable in coextensive relationship, each providing end portions for receiving a blade therebetween with a cutting edge thereof disposed beyond the ends thereof; means interengaging the clamping members functional as a fulcrum in permitting the end portions to displace in clamping a blade therebetween; means interconnecting the clamping members for angularly displacing the clamping members about the fulcrum; a guide member pivotally connected to a second end portion of each of the clamping members, pivotal between a first position disposed coextensively with a connected clamping member, and a second position at an angle relative to the connected clamping member, alignable with the guide member of the other of the clamping members, when the clamping members are disposed in coextensive; means interconnectable between the guide members when the guide members are disposed in alignment for releasably retaining the guide members in alignment; and an elongated member including a honing section and a guide member section cooperable with one of the guide for guiding the honing section along a cutting portion of a blade disposed between the clamping members.

11 Claims, 4 Drawing Sheets

BLADE SHARPENING ASSEMBLY

This invention relates to a blade sharpening assembly and more particularly to such an assembly which may be readily assembled and disassembled, and conveniently packaged for storing and handling purposes.

BACKGROUND OF THE INVENTION

In the prior art, there are number of blade sharpening kits available which generally have consisted of a pair of members cooperable for clamping a blade to be sharpened therebetween, a holder or support for such clamping members, and a tool provided with a honing stone and a guide rod which may be manually grasped by a user and guided over a protruding cutting edge of a blade for sharpening such end. Although such assemblies have been effective in providing a simple and readily usable arrangement for effectively sharpening blades, they typically consist of an excessive number of components required to be assembled and disassembled, and correspondingly are unsuitable to be readily contracted, into a compact package for storing and handling purposes. Accordingly, it is the principal object of the present invention to provide a blade sharpening kit which includes a minimum number of components, may be readily assembled for use, is easily and effectively usable and may be readily dissembled and packaged into a compact assembly which may be conveniently stored and handled.

SUMMARY OF THE INVENTION

The objectives of the invention are achieved by providing a novel blade sharpening assembly generally consisting of a pair of clamping members disposable in coextensive relationship, each having end portions for receiving a portion of a blade to be sharpened therebetween with the cutting edge thereof disposed beyond the ends thereof; means interengaging the clamping members functional as a fulcrum in permitting the end portions to displace in clamping a blade therebetween; means interconnecting the clamping members for angularly displacing the clamping members about the fulcrum; a guide member pivotally connected to a second end portion of each the clamping members, pivotal about a first position disposed coextensively with a connected clamping member, and at an angle relative to the connected clamping member, alignable with the guide member of the other of the clamping members, when the clamping members are disposed in coextensive relation; means interconnectable between the guide members when the guide members are disposed in alignment for detachably retaining the guide means in alignment; and a tool including a honing section and a guide section cooperable with one of the guide members for guiding the honing section along a cutting edge portion of a blade disposed between the clamping members. Preferably, the guide members include flange sections alignable when the guide members are aligned, and the interconnectable means comprises a slide mounted on one of such flanges and slidable onto the other of such flanges when aligned therewith, in spanning relation, to detachably connect the guide members together when in aligned relation.

DETAILED DESCRIPTION OF THE PREFERRED EMBODIMENT OF THE INVENTION

Figure 3:
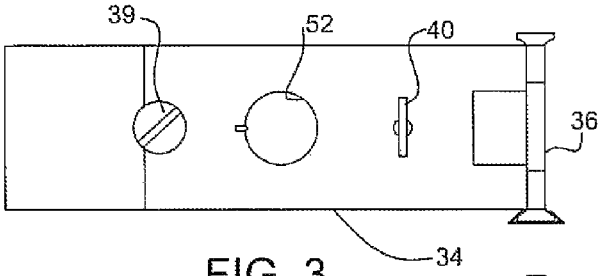
FIG. 3 is a top plan view of the embodiment shown in FIG. 1.

Referring to the drawings, there is illustrated a preferred embodiment of the invention which generally includes an assembly 20 for retaining a blade 21 to be sharpened, and a tool 22 cooperable with assembly 20 for sharpening the cutting edge of a blade 21. Assembly 20 includes a pair of clamping subassemblies 23 and 24 which may be supported on a support member 24, and tool 22 includes a base member 25 and a guide rod 26.

Figure 1:
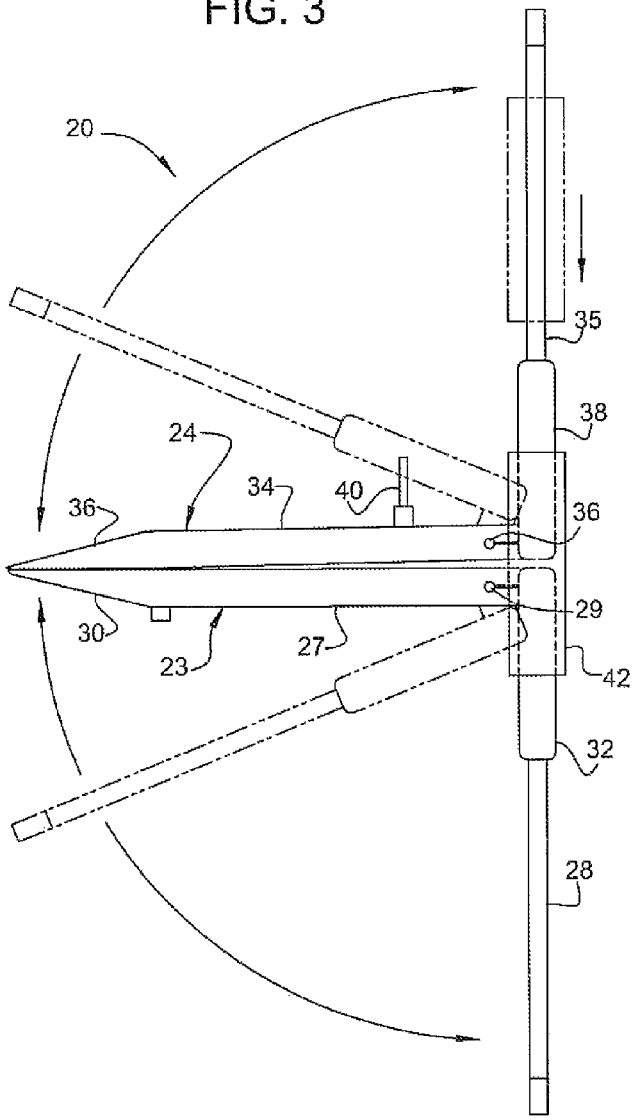
FIG. 1 is a side elevational view of an embodiment of the invention, illustrating the clamping members thereof in their assembled, coextensive relationship and the tool guiding members of each of the clamping members shown in solid lines in their assembled conditions and in phantom lines in their partially collapsed conditions.
Figure 2:
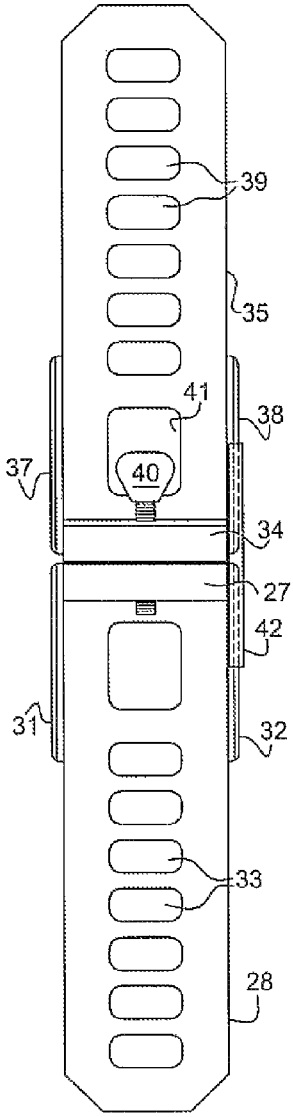
FIG. 2 is a front view of the assembly shown FIG. 1.

Clamping subassembly 23 includes a clamping member 27 and a guide member 28 pivotally connected to an end of clamping member 27 as at 29. Clamping member 27 has a substantially elongated, rectangular configuration and is beveled at a free end thereof as at 30. Guide member 28 is hingedly connected to the rear end of clamping member 27 and is adapted to pivot relative to clamping member 14 between a position as shown in FIG. 1, substantially perpendicular to clamping member 27, and a position underlying and disposed coextensively with clamping member 27. Guide member 28 further is provided with a pair of transversely spaced, longitudinally disposed flanges 31 and 32 disposed at an end thereof adjacent the hinged connection with clamping member 27, and a plurality longitudinally spaced openings 33, as best shown in FIG. 2. Subassembly 24 is essentially similar to subassembly 23 and includes a clamping member 34 and a guide member 35. Clamping member 34 is configured similarly to clamping member 27, having an elongated, rectangularly configured shape with a beveled edge 36. Guide member 35 is similar in construction to guide member 28 and is pivotally connected to an end of clamping member 34 as at 36. Similar to guide member 28, guide member 35 is displaceable between a position as shown in FIG. 1 approximately 90° relative to clamping member 34 and a position overlapping and disposed coextensively with clamping member 34. Also, as shown in FIG. 2, guide member 35 is provided with a pair of transversely spaced, longitudinally disposed flanges 37 and 38 disposed adjacent an end thereof hingedly connected to clamping member 34, and a plurality of longitudinally spaced openings 39.

As best seen in FIGS. 1 and 3, clamping members 27 and 34 are disposed coextensively with their free ends being provided with a screw 39 which extends through an opening in clamping member 34 and is threaded into an aligned threaded opening in clamping member 27, which functions as a fulcrum in permitting the free ends of the clamping members to displace angularly to grip a blade inserted between the free ends of the clamping members. Angular displacement of the free ends of the clamping members is provided by a winged screw 40 which is threaded through an opening in clamping member 34 and has a lower end thereof bearing on a surface of clamping member 27. By gripping the wing portion of such screw and turning it, the free ends of the clamping members may be angularly displaced to clamp and release a blade positioned therebetween.

Screws 39 and 40 maintain clamping members 27 and 34 in coextensive relationship as shown in FIG. 1. When guide members 28 and 35 are pivoted against the outer sides of clamping members 27 and 34 in first directions as shown in FIG. 1, such members will overlie coextensively, with flanges 31 and 32, lying adjacent the sides of clamping member 27, and flanges 37 and 38 lying along the sides of clamping member 34. when guide member 35 is pivoted from the position as shown in FIG. 2 to a position along clamping member 34, such movement is permitted by means of an opening 41 in guide member 35 through which the exposed end winged screw 40 is received to allow guide member 35 to assume a position overlying clamping member 34.

Referring to FIG. 2, when guide members 28 and 35 are disposed in longitudinal alignment, flanges 31 and 32 correspondingly will be disposed in alignment with flanges 37 and 38, respectively. The guide members may be releasably retained in such alignment by means of a slide 42 slidably mounted on flange 32 and movable onto and into engagement with aligned flange 38 of guide member 35, spanning the hinged connections of the guide members to the clamping members. Slide 42 has a substantially c-shaped configuration which overlaps the edges of flanges 32 and 38 and a pair of side edges which embrace the sidewalls of such flanges.

Figure 10:
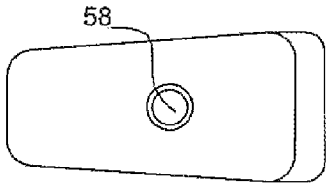
FIG. 10 is a bottom plan view of the member shown in FIG. 8.
Figure 11:
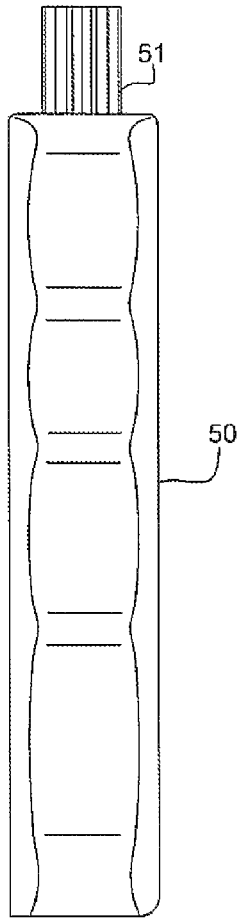
FIG. 11 is a front elevational view of the member shown in FIG. 8.
Figure 12:
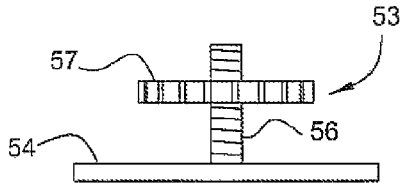
FIG. 12 is a side elevational view of a mounting device of the member shown in FIGS. 8 through 11.
Figure 13:
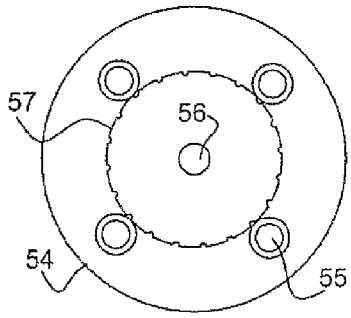
FIG. 13 is a top plan view of the mounting device shown in FIG. 12.

Support member 24 consists of an elongated handle 50 which may be gripped by the user, and a splined, protruding portion 51 which may be inserted through the underside of a similarly splined opening 52 in the clamping members to mount assembly 20 in its position as indicated by solid lines in FIG. 1, on handle 50. Handle 50 further is provided with an undulating configuration along one side thereof to accommodate the fingers of a user grasping such handle. Assembly 20 with handle 50 attached thereto may be simply held and used by a user or such handle with assembly 20 attached may be mounted on a support surface such as a bench and the like by means of a supporting device 53 as shown in FIGS. 12 and 13. Device 53 includes a base plate 54 provided with a set of circumferentially spaced openings 55 for securing such plate member to a support surface by means of threaded fasteners or otherwise, an upstanding threaded member 56 and a member 57 threaded on upstanding threaded stud 56. As shown in FIG. 10, the lower end of handle 50 is provided with a threaded opening 58 which may be aligned with and threaded onto threaded member 56 to support handle 50 on device 53 normally attached to a support surface. The handle threaded onto threaded member 56 may be secured in such position by threading member 56 up against the lower end of the handle in the conventional manner.

Figure 6:
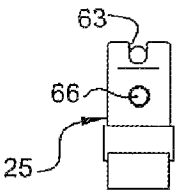
FIG. 6 is a front view of the tool showing in FIG. 4.
Figure 4:
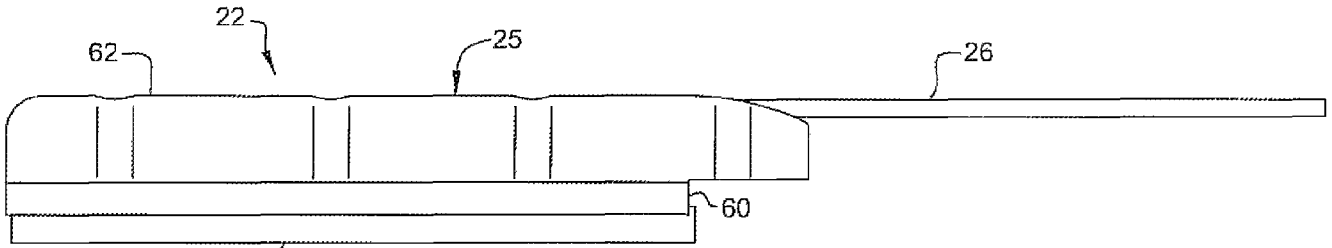
FIG. 4 is a side elevational view of a tool adapted to be used in conjunction with the assembly shown in FIGS. 1 through 3, depicting a rod section thereof disposed in a disassembled, stored position.
Figure 5:
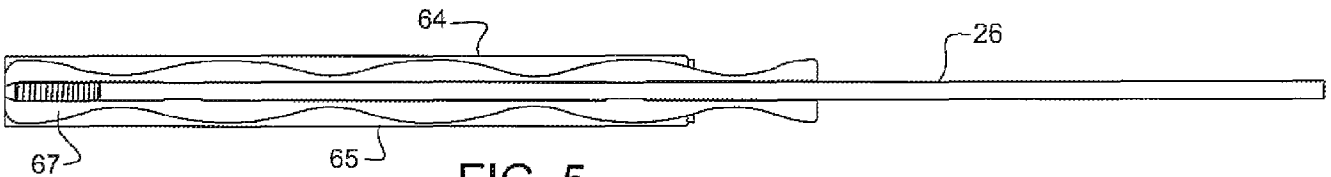
FIG. 5 is a top plan view of the tool shown in FIG. 4.

Referring to FIGS. 4 through 7, base member 25 of tool 22 includes an intermediate, elongated section 60, an elongated honing stone 61 secured to the underside of section 60 and an elongated section 62 rigidly secured to an upper side of member 60. An opposite surface of section 62 is provided with a longitudinally disposed groove 63 as best shown in FIGS. 5 and 6, and undulatingly configured side surfaces 64 and 65 as best shown in FIG. 5. Also as shown in FIG. 6, a front surface of section 62 is provided with a threaded opening 66. Guide rod 26 is provided with a threaded end 67, and may be disposed relative to base member 22 by inserting it in groove 63 as shown in FIGS. 4 through 5 or disposed in an operative position threaded in opening 26 as shown in solid lines in FIG. 7.

Figure 7:
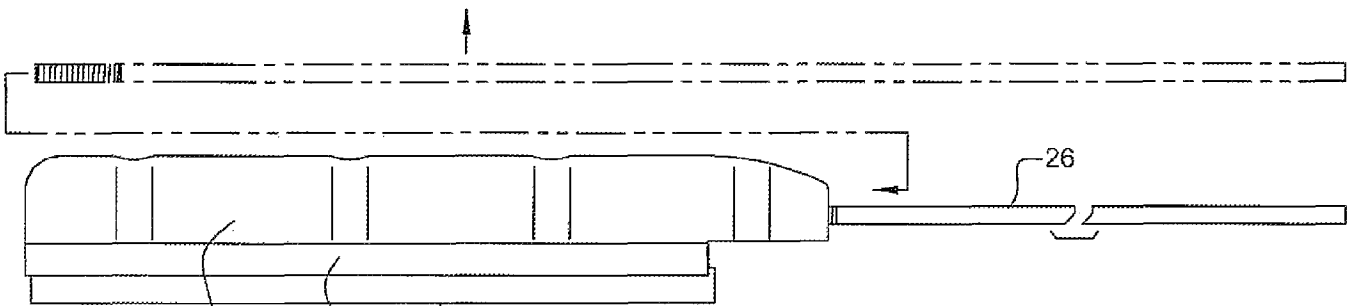
FIG. 7 is a view similar to the view shown in FIG. 4, illustrating the rod section thereof having been removed from its stored position, in phantom lines, and disposed in its operative position, in solid lines.
Figure 9:
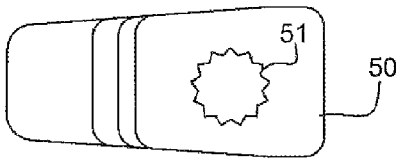
FIG. 9 is top plan view of the member shown in FIG. 8.
Figure 8:
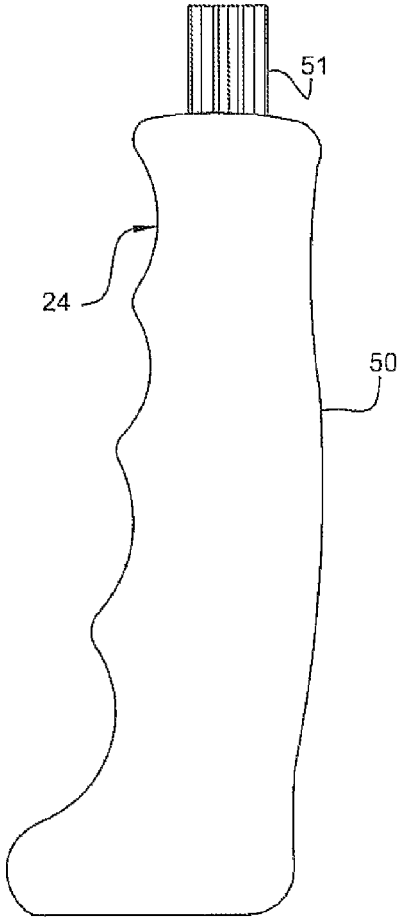
FIG. 8, is a side elevational view of a member which may be utilized to support the assembly shown FIGS. 1 through 3.
Figure 14:
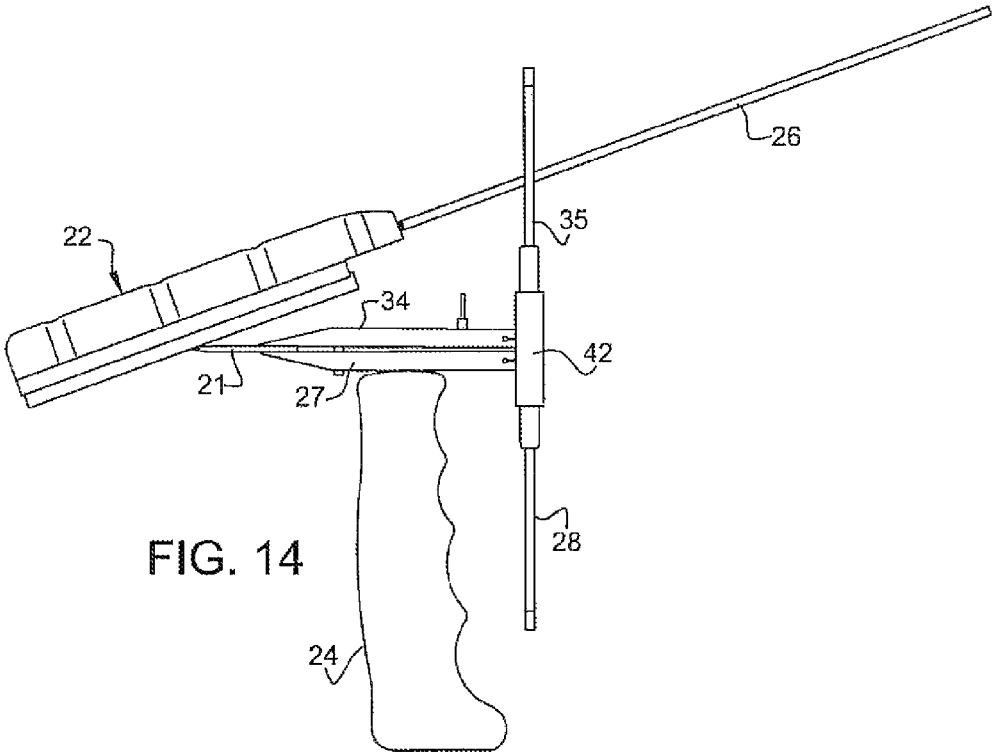
FIG. 14 is a side elevational view of the embodiment shown in FIG. 1 through 8, in which the member shown in FIG. 8 is utilized as a handle.
Figure 15:
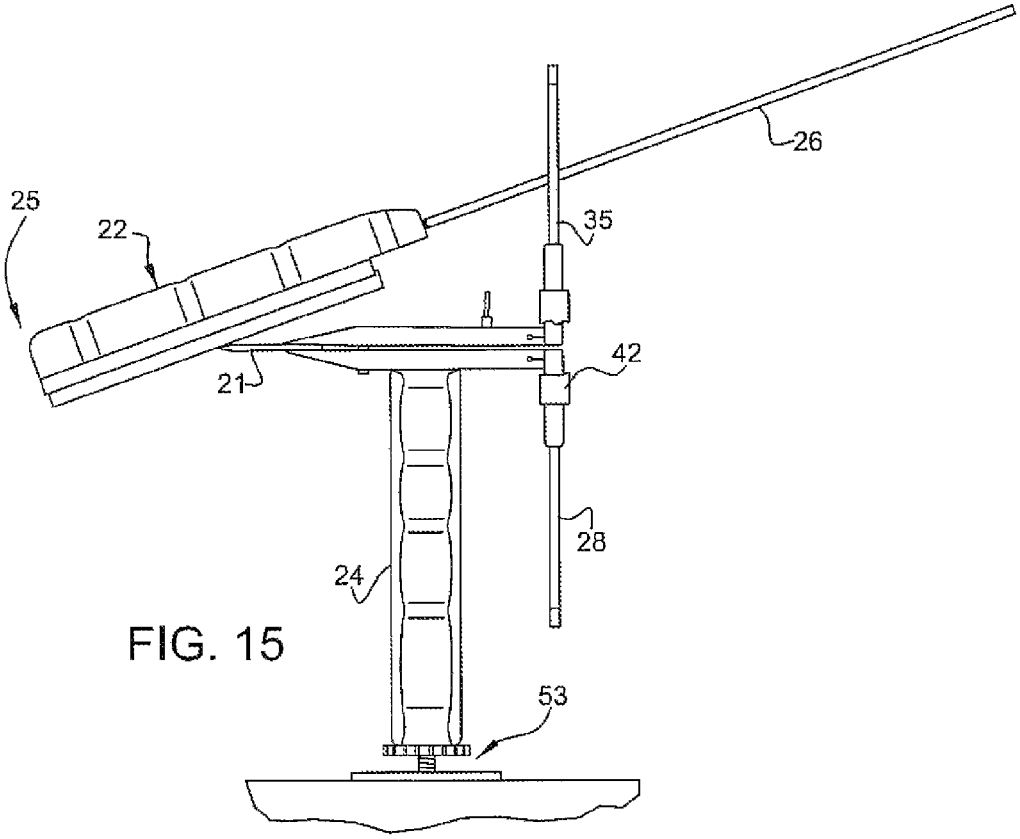
FIG. 15 is a view similar to the view shown in FIG. 14 in which the member shown in FIG. 8 is utilized as a support member mounted on a support surface.

When not use, assembly 20 in compact condition with guide members 28 and 35 pivoted into engagement with clamping members 27 and 34, support member 24, mounting device 53 and tool 22 with rod 26 mounted on base member 25 as shown in FIG. 5, may readily be stored in pockets of a cloth carrier, rolled and secured in a wrapped configuration. When such assembly is to be used, such components can be retrieved from the cloth carrier and assembled for use simply by positioning guide members 28 and 35 in their aligned positions and retained therein by means of slide 42 as shown in FIGS. 1 through 3, and either simply mounting such assembly on support member 24 as shown in FIG. 14 or mounting support member on mounting device 53 attached to a support surface as shown in FIG. 15 and then mounting assembly 20 on support member 24. Tool 22 may be converted into the operating mode simply be removing rod 26 from the groove in base section 62 and threaded it into the end of such section as shown in FIG. 7.

In the use of the sharpening assembly as described either in the condition as shown in FIG. 14 with the support member either held by one of the hands of the user or mounted on mounting device as shown in FIG. 15, 53, winged screw 40 is turned to open the free ends of clamping members 27 and 34 to allow the insertion of a blade 31 to be sharpened with the cutting thereof protruding beyond the ends of the clamping members. With the blade thus positioned, winged screw 40 is turned in the opposite direction to cause the ends of the clamp members to angularly displace toward each other about the fulcrum provided by screw 39 to rigidly secure the blade member between the clamping members. Tool 22 may then used in conjunction with assembly 20 to sharpen the edge of such blade simply by grasping the base portion of the tool with one hand, inserting the guide portion of the tool through one of the openings 39 in guide member 35, engaging the honing stone portion of the tool with the edge of the blade to be sharpened and simply running the honing stone against such edge in the conventional manner. The angle of the edge of the blade being sharpened can be varied simply by inserting the guide rod of the tool through different openings 39 of guide member 35. The opposite edge of the blade similarly may be sharpened simply by inverting assembly 20 on support member 24 and inserting the guide rod of the tool through one of openings 33 of guide member 28.

When the sharpening of the blade has been completed, the sharpening assembly may be disassembled for storage or further handling simply by detaching tool 22 from assembly 20, removing guide rod 26 from base member 25 of the tool and inserting such guide rod in groove 63 as shown in FIG. 5, removing assembly 20 from supporting member 24, displacing slide 42 along flange 32 of guide member 28, free of flange 38 of guide member 35 and pivoting guide members 28 and 35 alongside clamping members 27 and 34 to provide a compact body of such members, inserting assembly 20 in such compact condition, support member 24 and tool 22 also in compact condition in pockets of a cloth carrier, rolling such cloth carrier together and securing the carrier in such rolled condition.

The sharpening assembly as described provides only three basic components including assembly 20 which may be readily converted from a compact, nonoperating condition to an expanded operating condition, a support member 24 which may be connected to assembly 20 in its expanded condition and tool 22 convertible between a compact condition and a functional condition. Such components may be easily converted between compacted stored conditions and expanded functional conditions to facilitate their storage and usage. Although a slide mechanism is described in connection with the embodiment shown in the drawings for releasably securing the guide members in alignment, it is to be understood that other comparable means may be employed for releasably retaining such members in alignment.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. A blade sharpening assembly comprising:

first and second clamping members disposable in coextensive relationship, each having first end portions for releasably securing a blade thereon with a cutting edge thereof protruding therefrom;

a fulcrum member interengaging the clamping members and operable to permit the end portions to displace in clamping a blade therebetween;

a displacement member interconnecting the clamping members for angularly displacing the clamping members about the fulcrum member to engage the blade therebetween in clamping and unclamping relation;

a guide member pivotally connected to a second end portion of each of the clamping members, pivotal about a first position disposed coextensively with a connected clamping member, and a second position alignable with the guide member of the other clamping member, when the clamping members are disposed in coextensive relation;

a slide member interconnectable between the guide members when the guide members are disposed in alignment for releasably retaining the guide members in alignment; and an elongate member including a honing section and a guide section cooperable with one of the guide members for guiding the honing section along a cutting edge portion of a blade disposed between the clamping members.

2. The assembly of claim 1 wherein the fulcrum member comprises a threaded fastener extending through one of the clamping members and threaded into the other clamping member.

3. The assembly of claim 1 wherein the displacement member comprises a winged screw threaded through one of the clamping members and engaging the other clamping member.

4. The assembly of claim 1 wherein at least one of the guide members includes a surface spaced apart from the pivotal connection, the surface engageable by the guide section of the elongate member when the honing section thereof engages the cutting edge of a blade disposed between the clamping members.

5. The assembly of claim 1 wherein the guide members include flange sections alignable when the guide members are aligned, and the slide member is mounted on one of the flanges and is slidable onto the other of the flanges when aligned therewith, in spanning relation, to releasably connect the guide members together when in aligned relation.

6. The assembly of claim 1 wherein the honing section of the elongate member includes an abrasive portion and a handle portion which may be manually gripped and reciprocated to guide the abrasive portion along the cutting edge of a blade disposed between the first end portions of the clamping members.

7. An assembly for retaining a blade for sharpening, comprising:

first and second clamping members disposable in coextensive relationship, each having first end portions for releasably securing a blade thereon with a cutting edge thereof protruding therefrom;

a fulcrum member interengaging the clamping members and operable to permit the end portions to displace in clamping a blade therebetween;

a displacement member interconnecting the clamping members for angularly displacing the clamping members about the fulcrum member to engage the blade therebetween in clamping and unclamping relation;

a guide member pivotally connected to a second end portion of each of the clamping members, pivotal about a first position disposed coextensively with a connected clamping member, and a second position at an angle relative to a connected clamping member, alignable with the guide member of the other clamping member when the clamping members are disposed in coextensive relation;

a slide member interconnectable between the guide members when the guide members are disposed in alignment for releasably retaining the guide members in alignment; and wherein at least one of the guide members is provided with at least one surface on which a portion of an elongate member is provided with a honing section engageable with the cutting edge portion of a blade disposed between the clamping members.

8. The assembly of claim 7 wherein the fulcrum member comprises a threaded fastener extending through one of the clamping members and threaded into the other clamping member.

9. The assembly of claim 7 wherein the displacement member comprises a winged screw threaded through one of the clamping members and engaging the other clamping member.

10. The assembly of claim 7 wherein at least one of the guide members includes two longitudinally spaced openings spaced apart from the pivotal connection, each opening engageable by the guide section of the elongate member when the honing section thereof engages the cutting edge of a blade disposed between the clamping members.

11. The assembly of claim 7 further comprising a support member for supporting the clamping members.

* * * * *